US005475980A

United States Patent [19]

Grenier et al.

[11] Patent Number: 5,475,980

[45] Date of Patent: Dec. 19, 1995

[54] PROCESS AND INSTALLATION FOR PRODUCTION OF HIGH PRESSURE GASEOUS FLUID

[75] Inventors: Maurice Grenier, Paris, France; Bao Ha, Vacaville, Calif.

[73] Assignees: L'Air Liquide, Societe Anonyme pour l'Etude l'Exploitation des Procedes Georges Claude, Paris, France; Liquid Air Engineering Corporation, Montreal, Canada

[21] Appl. No.: 219,349

[22] Filed: Mar. 29, 1994

Related U.S. Application Data

[63] Continuation-in-part of Ser. No. 176,137, Dec. 30, 1993, abandoned.

[51] Int. Cl.[6] ..... F25J 3/02

[52] U.S. Cl. ..... 62/24; 62/38; 62/41

[58] Field of Search ..... 62/38, 24, 41

[56] References Cited

U.S. PATENT DOCUMENTS

| | | | |
|---|---|---|---|
| 4,303,428 | 11/1981 | Vandenbussche | 62/13 |
| 5,157,926 | 10/1992 | Guilleminot | 62/24 |
| 5,303,556 | 4/1994 | Dray et al. | 62/24 |
| 5,379,598 | 1/1995 | Mostello | 62/24 |
| 5,398,514 | 3/1995 | Roberts et al. | 62/38 |

*Primary Examiner*—Ronald C. Capossela
*Attorney, Agent, or Firm*—Young & Thompson

[57] ABSTRACT

Auxiliary gas is withdrawn from the heat exchanger during cooling or reheating at an intermediate temperature which is close to the vaporizing temperature of the oxygen or nitrogen high pressure product stream, then compressed by a cold compressor and reintroduced in the heat exchanger. The invention is particularly applicable to the production of gaseous oxygen at a pressure greater than about 15 bar.

52 Claims, 4 Drawing Sheets

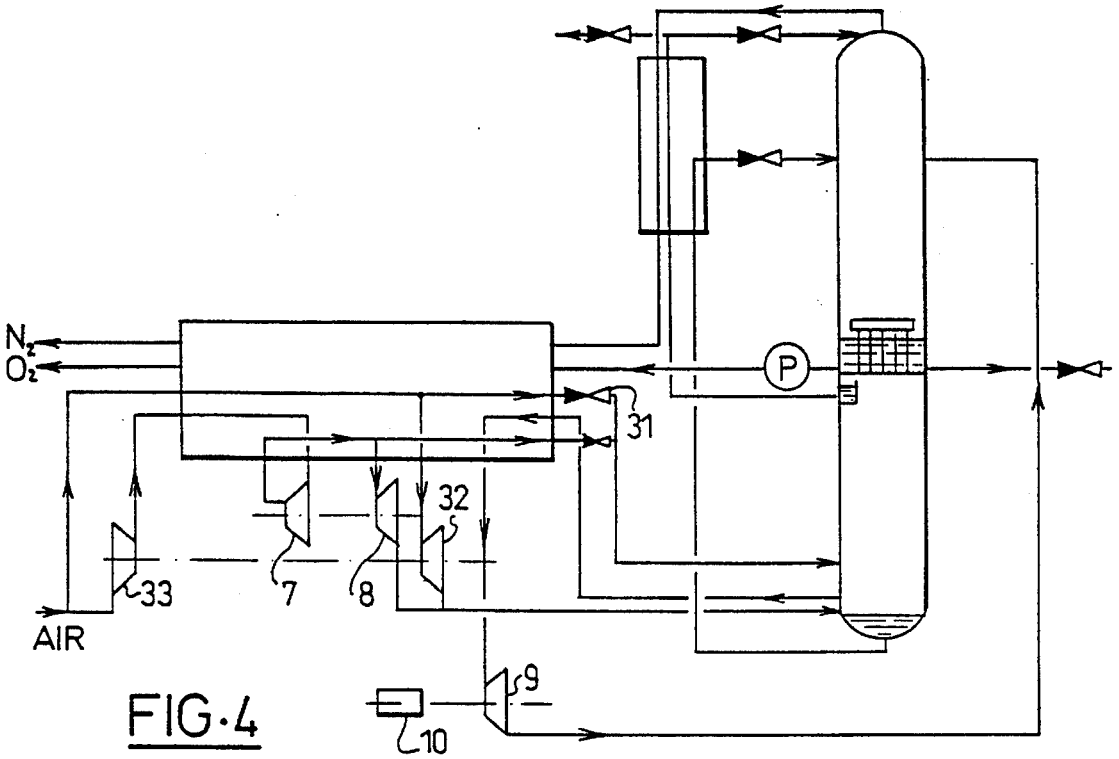
FIG·4
FIG·5
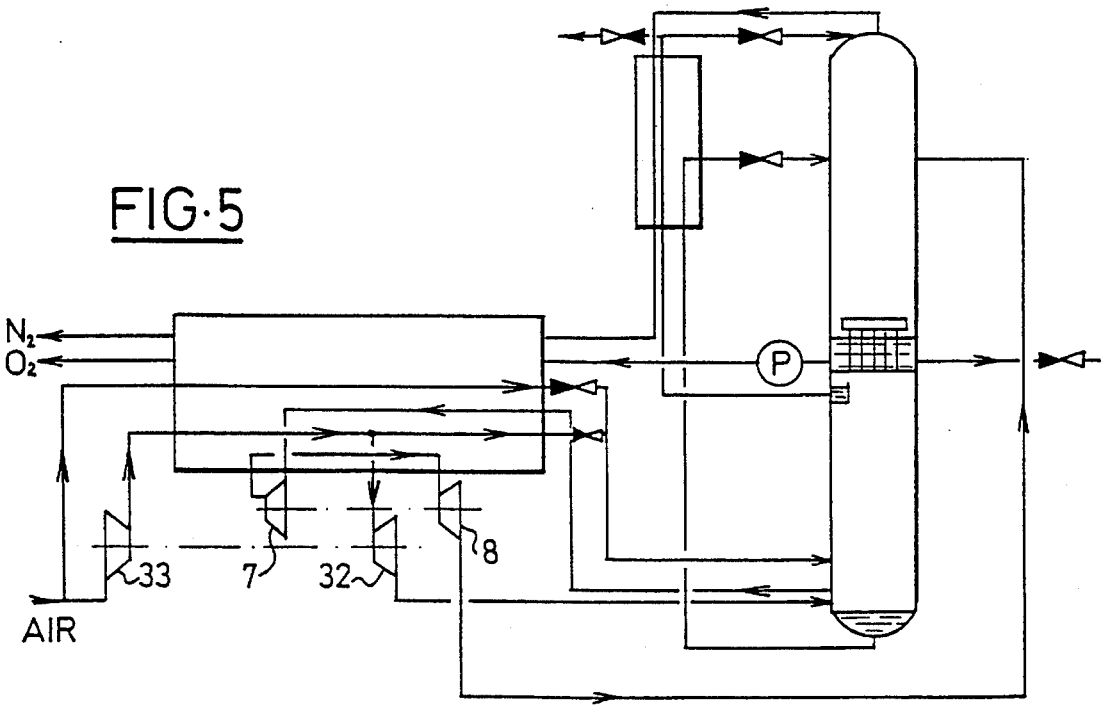

PROCESS AND INSTALLATION FOR PRODUCTION OF HIGH PRESSURE GASEOUS FLUID

This is a continuation-in-part of U.S. Ser. No. 08/176,137 filed Dec. 30, 1993, now abandoned.

BACKGROUND OF THE INVENTION

The present invention relates to a process for the production of at least one high-pressure gaseous fluid which comprises fluid selected from the group consisting of oxygen and nitrogen, by cryogenic air separation, said fluid being pumped in a liquid state to an elevated pressure, then vaporized and reheated at an elevated pressure in a heat exchanger.

In this specification, the term "high pressure" means a pressure which is greater than about 15 bar for oxygen and a pressure which is greater than about 30 bar for nitrogen. The term "blower" means a compressor having a compression ratio of less than about 2. The term "cold blower" means a blower operating at an inlet temperature of less than about minus 40° C. Furthermore, any pressure referred to herein is an absolute pressure.

The processes disclosed in the art relating to the production of oxygen by the so-called "pump processes" have some advantageous features; such as avoiding the use of product oxygen compressor which is usually very expensive, unreliable and gives a very poor yield.

However, in order to use the previously described liquid "pump processes", an operator must attempt to balance the excess of cold brought about by the vaporization of product fluid, and to bring a sufficient quantity of an exchange fluid in heat exchange relationship with the product fluid, said exchange fluid being capable of condensing at about the vaporization temperature of the product fluid, or alternatively which exchange fluid heat capacity is sufficient at this temperature.

The exchange fluid characteristic requirements are thus a significant limitation to the possible use of the so-called "pump processes", particularly when the production pressure of oxygen is high, i.e. greater than about 15 bar. For example, for an oxygen pressure greater than about 15 bar, it would be necessary to compress to a high pressure a flow of air or nitrogen which is at least equal to 150% of the oxygen flow, which is impractical and expensive in terms of energy.

A process and installation to effectively carry out the production of high pressure gaseous fluid from a liquid would be advantageous and is much desired.

SUMMARY OF THE INVENTION

One object of the present invention is to provide a flexible and economical process wherein the excess of cold produced by the vaporization of a high pressure product, preferably a substantially oxygen product, is carried out utilizing an improved and well balanced heat exchanger system.

In one sense, the process according to the present invention comprises withdrawing a portion of an auxiliary gas from the heat exchanger during the cooling or the heating of the auxiliary gas at an intermediate temperature which is close to the vaporization temperature of a high pressure product fluid undergoing vaporization, or to the pseudo-vaporization temperature of this product fluid if said high pressure is a supercritical pressure; compressing withdrawn auxiliary gas and then re-injecting compressed auxiliary gas into the heat exchanger.

According to one embodiment of the invention, the auxiliary gas comprises at least a portion of the incoming air undergoing cooling prior to an air separation process, said air being optionally first pressurized, at ambient temperature, by a hot blower. In the case wherein the air separation process is carried out in a double column system, the auxiliary gas may comprise air withdrawn from the high pressure column, said auxiliary gas reheated to about said intermediate temperature prior to said withdrawal and then after said compressing and said re-injecting steps, the auxiliary gas is further cooled and then expanded to a lower pressure and, optionally, injected in the low pressure column of the double column system.

According to another embodiment of the invention, the auxiliary gas comprises a predominantly nitrogen stream from the air separation process, withdrawn from the air separation unit, reheated to about ambient temperature, then compressed and cooled. According to still another embodiment, the withdrawn auxiliary gas may be a fluid from an air separation process which fluid has been at least partially reheated.

According to another embodiment of the invention, said gas from the air separation cycle comprises a portion of the auxiliary gas injected in the heat exchange line, said portion being withdrawn from said heat exchange line at a second intermediate temperature which is lower than the first intermediate temperature.

According to a different embodiment of the invention, at least one expansion of a gas from the air separation cycle is carried out in a turbine, with the auxiliary gas being compressed with a blower driven at least in part by the turbine.

In the preferred embodiment, a single expander is mechanically coupled with the cold blower, and optionally also with an oil-brake or generator via a common shaft or gear system. In this embodiment, at least a fraction of the work extracted by the expander is utilized to compress auxiliary gas withdrawn from the heat exchanger which compressed auxiliary gas will be utilized to assist in vaporizing the high pressure product stream in the heat exchanger, and the remaining fraction of work from the expander is dissipated, thus providing the required refrigeration for the air separation or other process.

According to another embodiment of the invention, an additional oxygen and/or nitrogen product is produced at an intermediate pressure by pumping and then vaporization/reheating liquid in the heat exchanger, the intermediate pressure being selected such that the additional product is fully vaporized and reheated by heat exchange with other available streams in the heat exchanger.

Another object of the invention is to provide an installation in which to carry out one of the above processes to produce a high pressure gaseous fluid product. The installation comprises a double column air separation system comprising a low pressure column and a high pressure column and a heat exchanger wherein the incoming air is in heat-exchange relationship with fluids withdrawn from the double column system. The installation further comprises means for pumping liquefied fluid withdrawn from the air separation unit to an elevated pressure at least as great as the high pressure product pressure, said installation further comprising a cold blower, means for feeding the cold blower with a cooled or reheated auxiliary gas withdrawn from the heat exchanger at an intermediate temperature, and means for injecting said compressed auxiliary gas into conduits of the heat exchanger.

BRIEF DESCRIPTION OF THE DRAWINGS

FIGS. 3–7 represent at least four different embodiments of installations and processes according to the invention.

DETAILED DESCRIPTION OF THE PREFERRED EMBODIMENTS

Figure 1:
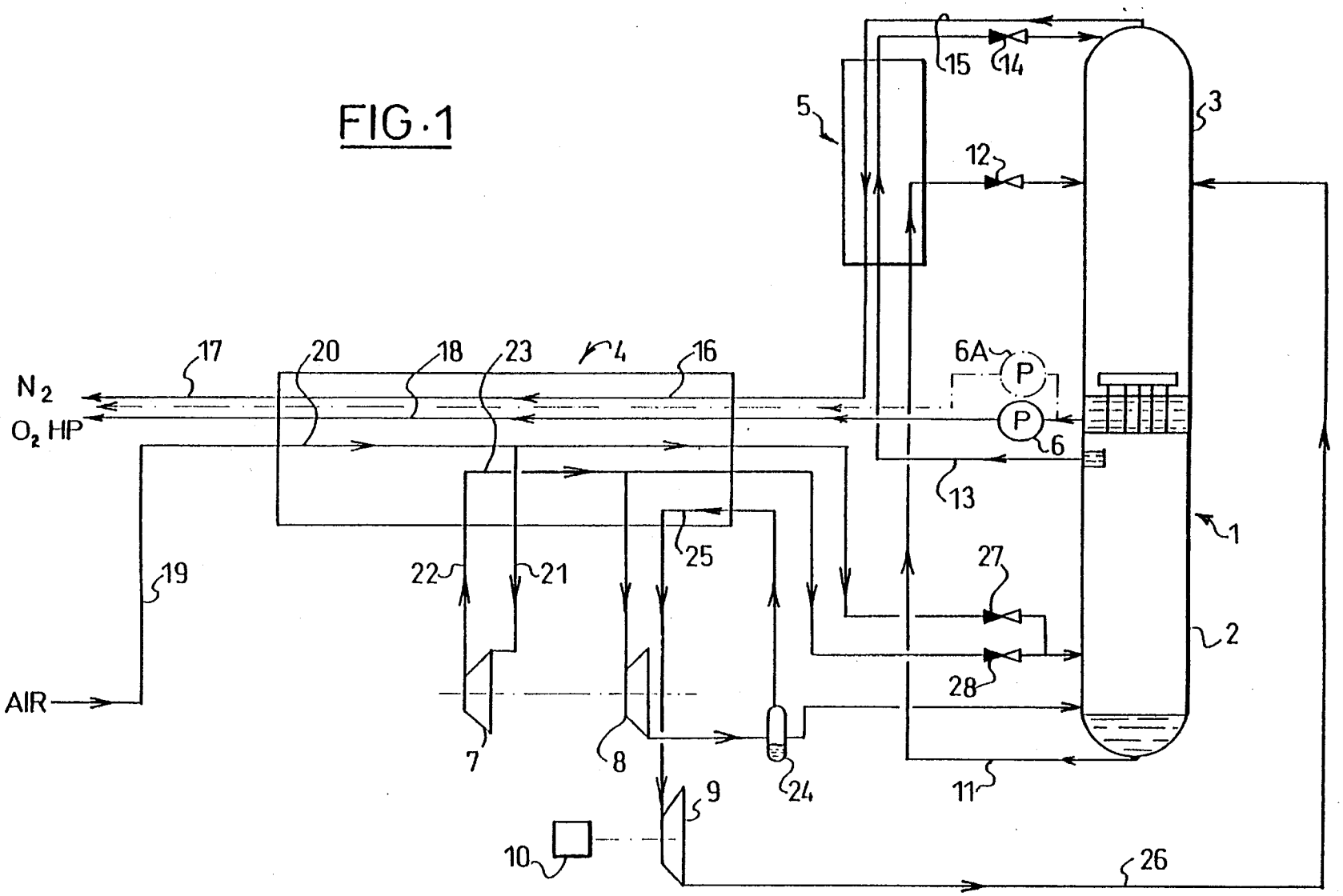
FIG. 1 represents schematically an installation for producing high pressure gaseous oxygen according to the invention.

The installation shown on FIG. 1 is designed for the production of a high pressure gaseous fluid (e.g., preferably between about 30 and about 40 bar), in this case a substantially oxygen product. The installation comprises a double column air separation unit 1 comprising a high pressure column 2, which internal pressure is preferably about 6 bar, and a low pressure column 3, which internal pressure is preferably slightly greater than 1 bar, a heat exchanger 4, a subcooler 5, a liquid oxygen pump 6, a cold blower 7, a first turbine 8, which wheel is mounted on the same axis as the cold blower, and a second turbine 9, which may optionally be decelerated by an appropriate brake 10, such as an alternator.

In the embodiment of the present invention as depicted in FIG. 1 are represented the usual flow conduits associated with a double column process. Conduit 11 delivers to an intermediate stage of column 3, after preferably subcooling in cooler 5 and expansion to lower pressure in an expansion valve 12, a portion of the "rich" liquid (oxygen enriched air) collected in the sump of the column 2.

Conduit 13 is provided to bring to the top of the column 3, after preferably subcooling in 5 and expansion at the low pressure in an expansion valve 14, "poor" liquid (typically substantially nitrogen) withdrawn from the top of the column 2. Conduit 15 comprising impure nitrogen is also provided, which is the residue gas of the installation. Conduit 15 also preferably passes through the subcooler 5 and then is connected to passages 16 for reheating the residue nitrogen in the heat exchanger 4. The impure nitrogen-rich residue gas after such reheating to about ambient temperature is vented from the installation through a conduit 17.

In the embodiment of FIG. 1, pump 6 preferably withdraws substantially liquid oxygen at about 1 bar from the sump of column 3, at least a portion of said liquid oxygen then being pumped to at least the desired product pressure and then introduced in the passages 18 of the heat exchanger 4. Feed air to be separated flows through conduit 19, preferably at a pressure of about 16.5 bar, and then into the passages 20 to cool the feed air in the heat exchanger 4.

In accordance with the present invention, when the feed air undergoing cooling is at an intermediate temperature T1 which is lower than the ambient temperature and preferably slightly higher than the vaporization temperature $T_v$ of oxygen (or of pseudo-vaporization if the production pressure of oxygen is supercritical), a portion of the feed air is withdrawn from the heat exchange line through a conduit 21 and flowed to the suction of a cold blower 7. Cold blower 7 compresses the withdrawn portion to a pressure of about 23 bar and said compressed air is then flowed back in conduit 22 to the heat exchanger at a temperature T2 which is greater than T1, said compressed and re-injected air being further cooled in compressed air passage 23 in said heat exchanger.

In the embodiment of FIG. 1, a portion of the compressed air flowing through the passage 23 is again withdrawn from the heat exchanger at a second intermediate temperature T3, which is lower than T1, and expanded, preferably to a pressure of about 6 bar in expansion turbine 8. In this embodiment, the expanded air exhausting from turbine 8 preferably flows in a phase separator 24 and a portion is then flowed to the column 2. A portion of the vapor phase from the separator 24 is preferably partially reheated in passage 25 of the heat exchanger up to an intermediate temperature T4 which is lower than T3, then expanded in turbine 9 and flowed to an intermediate point of the column 3 through conduit 26.

In the embodiment of FIG. 1, the portion of feed air flowing through the conduit 20 which is not sent in the conduit 21 to the cold blower 7 is further cooled until reaching the cold end of the heat exchanger wherein it is in a liquefied and subcooled state. It is then expanded in expansion valve 27 and enters column 2 at a location at least one theoretical tray above the sump of the column 2. Similarly, the air flowing through the conduit 23 and which does not flow through the turbine 8, is cooled until reaching the cold end of the heat exchange line, then expanded in an expansion valve 28 and then enters the high pressure column 2 at a location at least one theoretical tray above the sump of the column.

Thus, in accordance with the present invention and the embodiment of FIG. 1, the withdrawal and compression of at least a portion of the incoming air at the intermediate temperature T1, which is close to the vaporization temperature of oxygen, and re-injection at the temperature T2, introduces a certain quantity of heat in the heat exchanger. This occurs at a location in the heat exchanger which is at a temperature between these two temperatures T1 and T2, which in accordance with the invention, advantageously compensates for the excess of cold produced by the vaporization of oxygen product.

Figure 2:
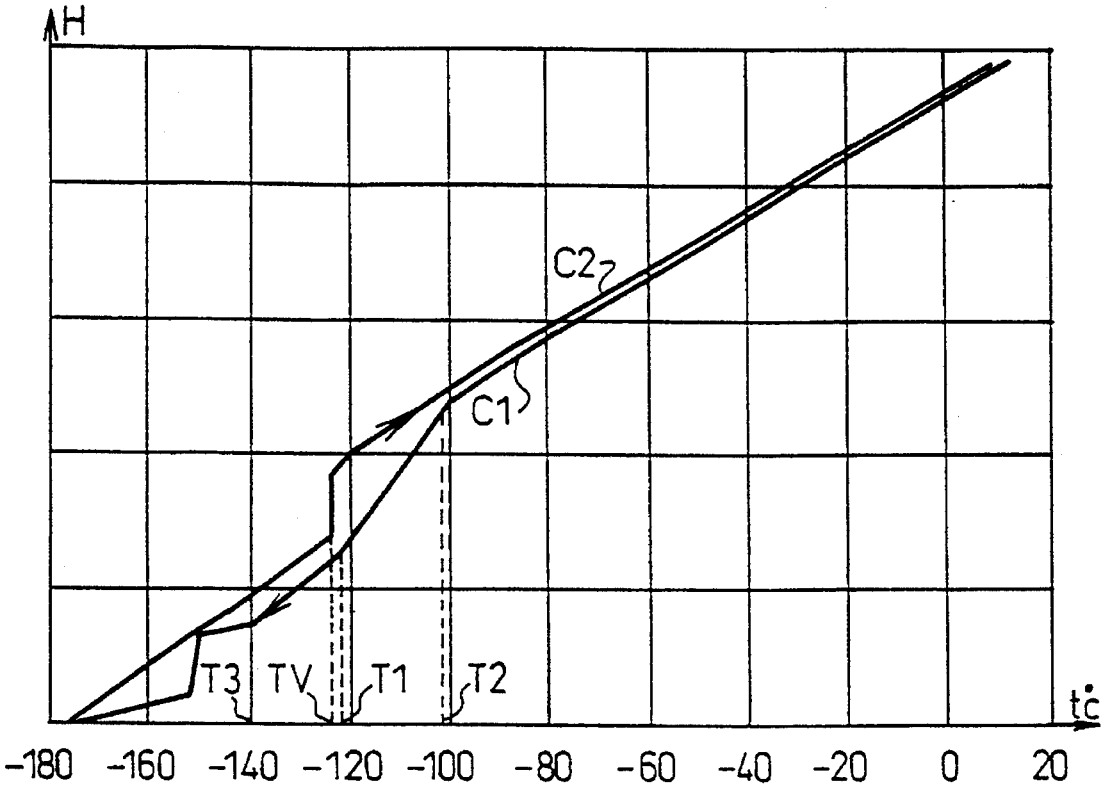
FIG. 2 represents a heat exchange diagram obtained from calculation, corresponding to the installation of FIG. 1, wherein the enthalpy of the different fluids is on the Y-axis and the temperatures are on the X-axis.

In accordance with the compressed air embodiment of the present invention, between T2 and T1 the high pressure oxygen product exchanges heat with the incoming partially compressed air at about 16.5 bar and further with the compressed air at about 23 bar. It is thus possible to obtain a heat exchange diagram (enthalpy along the Y-axis, temperature along the X-axis) which is very favorable, with a small difference of temperature, preferably between about 2° C. and 3° C. at the warm end of the heat exchanger 4. This favorable result is represented in FIG. 2, wherein curve C1 represents cooling, of air and curve C2 represents reheating of oxygen and nitrogen.

Referring again to FIG. 1, in a preferred embodiment, blower 7, which carries out the compression of a portion of incoming compressed air, is driven by the turbine 8 such that no external energy is necessary. In view of mechanical losses, the quantity of cold produced by the expansion in turbine 8 is slightly greater than the heat produced by compression, and thus the excess is useful to maintain the installation cold. In one alternative embodiment, complementary cold necessary to keep the installation cold may be provided by the turbine 9, which cools fluid for delivery to an intermediate point in column 3.

According to another embodiment of the invention, if the oxygen product needs to have a high purity, additional cold may be provided by expansion of air or high pressure nitrogen in a turbine. In another embodiment, it may be preferable to provide only one expander mechanically coupled with an oil-brake, or alternatively with a generator. Such a single expander may be also coupled via a gear or a common shaft with a cold compressor, alone or in combination with the oil-brake.

According to another alternate embodiment, the compression of air may be made with two cold blowers connected in series, each of them being preferably driven by an expansion turbine. These blowers are selected in such a way that the sum of the compression heat is about equal to the excess of cold produced by the vaporization of oxygen, i.e. equal to the vaporization latent heat.

According to another embodiment, the single cold blower or each of the multiple cold blowers can compress gas other than the air flowing through the heat exchange line, such as "cycle nitrogen" which has been first reheated up to the ambient temperature, then compressed and which is now under cooling.

In each of these different embodiments, the compression heat of the single or each of the multiple cold blowers may be less than the excess of cold produced by the vaporization of oxygen in which case the complement may be made up by any other means.

Stated differently, in each of these embodiments, compression means are selected and operated such that the compression heat of the single or each of the multiple cold blowers make up the difference between the heat contained in the products which are flowing away from the columns, comprising the vaporized oxygen, and the enthalpy change of the incoming feed air.

The complement of heat as referred to above may be obtained by the production of a certain quantity of liquid. In fact, the deficit in cold due to the decrease of the quantity of cold gas sent in the heat exchange line reduces the heat to be provided by the single or each of the cold blowers.

The overall power consumption for the air separation plant comprising the present invention compares favorably to that for a conventional plant available prior to the present invention, primarily through eliminating the need for an oxygen or product compressor.

FIGS. 3–7 represent examples of various embodiments of the present invention disclosed above. The embodiments of FIGS. 3–7 are different from the embodiment disclosed in FIG. 1 primarily in the way the inflowing air is treated.

Figure 3:
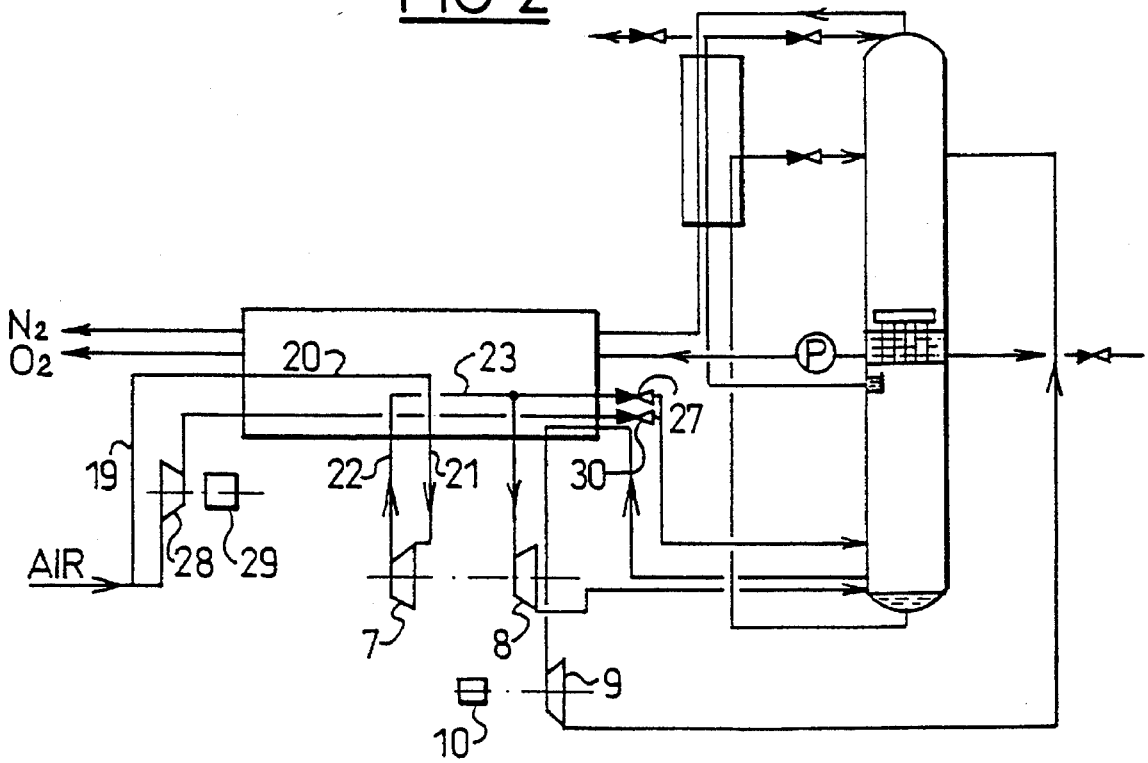

In the case of the embodiment of FIG. 3, only the major portion of the air flowing at about 16.5 bar is cooled at T1, compressed by the blower 7 and reintroduced in the heat exchange line at a temperature T2 greater than T1. It is thereafter partly liquefied, subcooled, and expanded at about 6 bar in the expansion valve 27 and introduced in the column 2, and then partially expanded at 6 bar in the turbine 8.

However, in the embodiment of FIG. 3, a portion of the feed air preferably at about 16.5 bar, which flow is less than the oxygen flow to be vaporized, is compressed at ambient temperature by an additional blower 28, which may be driven by an electrical motor 29, up to a pressure which is preferably not more than about 30 bar. The compressed stream is then flowed through the heat exchanger, where it is liquefied and subcooled, and then expanded in an expansion valve 30 into the high pressure column 2.

In the embodiment of FIG. 3, the compressed air flow essentially reheats the intake of air to the turbine 8 and thereby avoids the detrimental presence of liquid at the input to the wheel of this turbine. Further with respect to this embodiment, the high pressure air expanded to a lower pressure in the turbine 9 is here withdrawn from the sump of the column 2, and not from the output of the turbine 8, as in the embodiment of FIG. 1.

In the embodiment of FIG. 4, a portion of the incoming air at about 16.5 bar is cooled to an intermediate temperature which is lower than $T_v$ and divided into two fractions. The first fraction is liquefied, subcooled, expanded at 6 bar through an expansion valve 31 and sent back to the column 2, and a second fraction which is expanded at 6 bar in an additional turbine 32 then sent to column 2.

The second fraction of the air at about 16.5 bar, which is preferably about 50–80% of the total incoming air, is compressed at ambient temperature by a hot blower 33 mechanically coupled to the turbine 32, cooled to T1, compressed to preferably about 30 to 35 bar by the cold blower 7 and reintroduced in the heat exchange line at temperature T2 which is greater than T1. A portion of the reintroduced air is then cooled further until reaching the cold end of the heat exchange line, and a portion of the reintroduced air is expanded at 6 bar in the turbine 8 as disclosed hereabove, and sent to column 2.

With the type of installation depicted in FIG. 4, the production of liquid by the installation is typically small, with a maximum on the order of magnitude of about 2% of the flow of the incoming air. This production of liquid may even be equal or nearly equal to zero, if the pressure of the incoming air is reduced to about 15.5 bar. Furthermore, a portion of the first fraction of incoming air may be expanded in turbine 32, at a temperature preferably less than T2. In this case turbine 9 is optional.

According to the embodiment depicted in FIG. 5, a small portion (0–15%) of the air at 16.5 bar is cooled, liquefied and subcooled, then expanded in an expansion valve and sent to the column 2. The remaining incoming air is compressed to about 23 bar at ambient temperature with the compressor 33, and then cooled to a temperature which is lower than $T_v$. A fraction of this air is then expanded to about 6 bar in the turbine 32 and then sent to column 2, the rest being cooled until reaching the cold end of the heat exchanger where it is expanded to about 6 bar and sent to the column 2.

In the embodiment of FIG. 5, the auxiliary gas fed to cold blower 7 is gas withdrawn from the sump of the column 2 and reheated to temperature T1. This gas, after compression to about 10 bar in blower 7, is reintroduced at a temperature T2 which is greater than T1 in the heat exchanger, cooled to temperature T3 which is lower than the entrance temperature of the turbine 32, expanded to about 1.2 bar in the turbine 8 and thereafter injected at an intermediate point of the column 3.

The embodiment of FIG. 5 is particularly adapted to the production of lower purity oxygen product at a pressure between about 30 to 40 bar, wherein preferably about 25% of the incoming air flow is compressed by the cold blower 7 and wherein the production of liquid is about 3% of the total flow of the incoming air.

Figure 6:
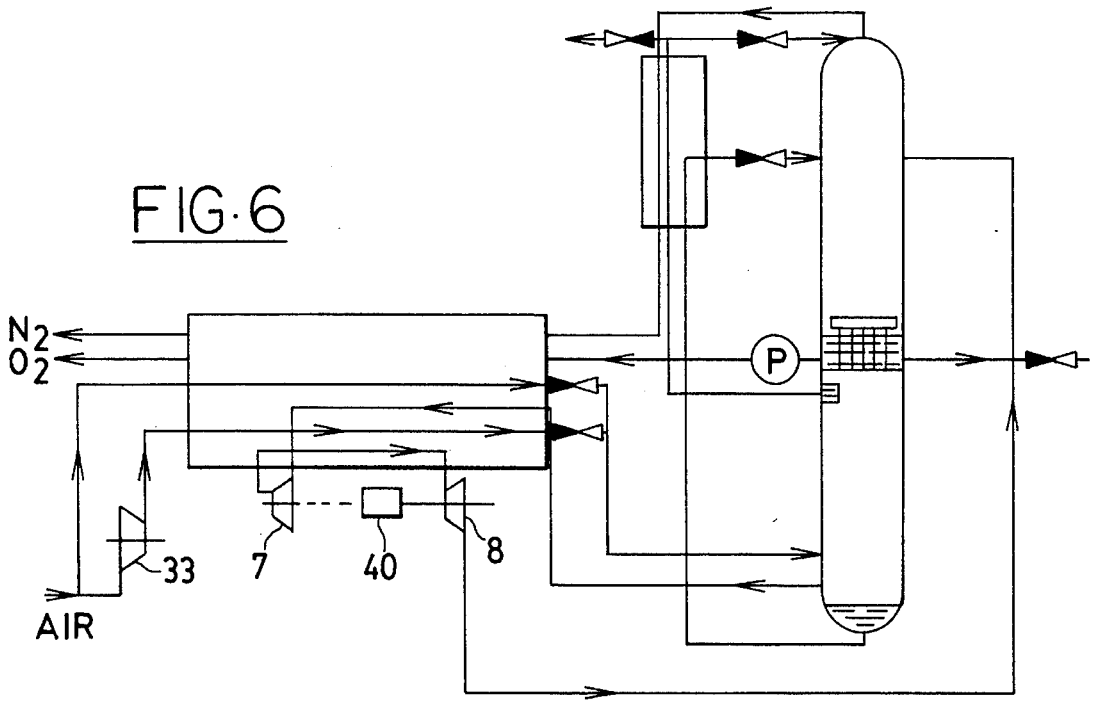

The embodiment depicted in FIG. 6 is similar to the embodiment of FIG. 5, but includes an energy absorbing device 40, such as an oil-brake or generator set, mechanically coupled with the expansion turbine 8, which reduces the size of the second turbine 32, depicted in FIG. 5, or preferably eliminates the costly second turbine from the installation, as depicted in FIG. 6. The energy absorbing device 40 may also be mechanically coupled to the common shaft or gear system to the cold compressor 7. By proper sizing and control of the energy consuming device 40, preferably in relation to production of high pressure oxygen product, in accordance with the present invention, the heat exchanger and process performance is maintained at a highly efficient level.

Figure 7:
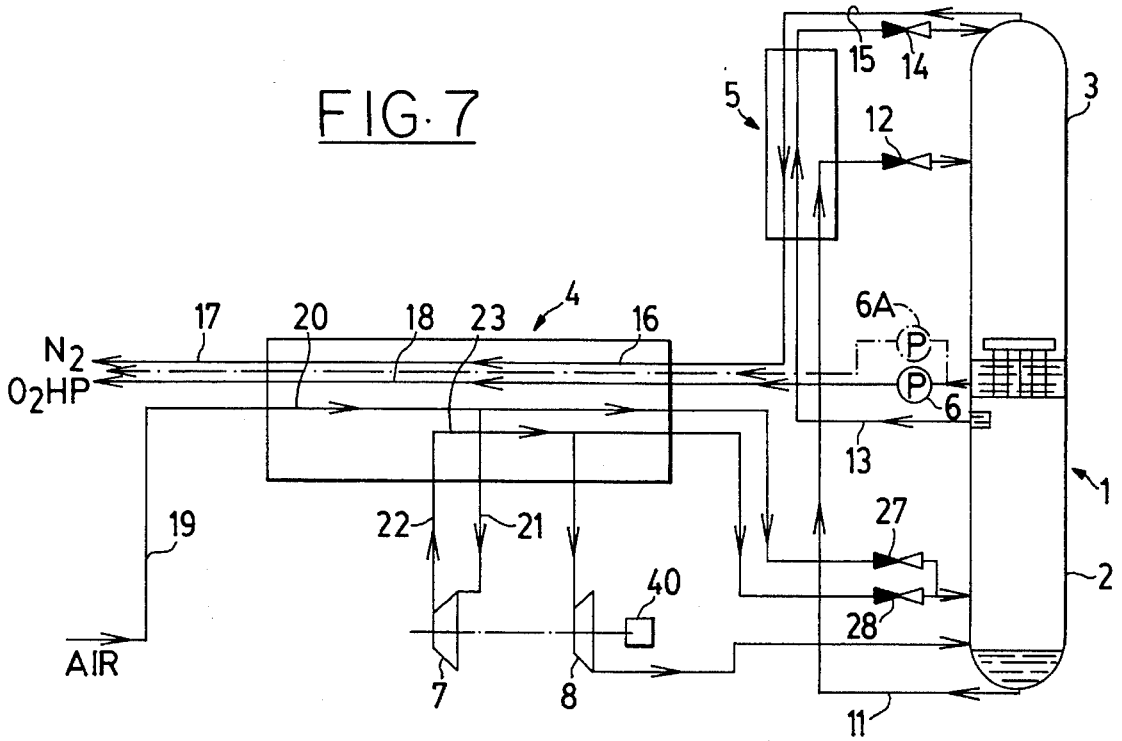

The embodiment of FIG. 7 is somewhat similar to that of FIG. 1, however; the process depicted in FIG. 7 provides an energy absorbing device 40, such as an alternator or oil-brake, mechanically coupled to the single expansion turbine 8 and optionally cold compressor 7 to provide the needed refrigeration without the use of an additional expander. The gas is withdrawn for expansion at a point in the heat exchanger wherein the temperature is less than the temperature of the reintroduced gas, expanded in turbine 8, and the expanded gas is flowed to the high pressure column.

An additional aspect of the present invention is that embodiments according to the invention may be used to produce gaseous oxygen under two different pressures, wherein one is sufficiently low to allow the vaporization of oxygen by condensation of air at the highest pressure of the air in the process. This oxygen pressure would be, e.g. lower than about 8 bar in the cases of FIGS. 1, 3 and 5, and lower than about 15 bar in the case of FIGS. 4, 6 and 7.

Alternatively, as has been represented by dashed line on FIG. 1, a second pump 6A to compress liquid oxygen at an intermediate pressure, preferably lower than about 8 bar is possible. This second oxygen product is preferably vaporized by condensation of a portion of the compressed air compressed by the blower 7, which blower has only to provide the heat to compensate for the excessive cold resulting from the vaporization of the high pressure oxygen.

In another embodiment, the pump 6A could also be a medium pressure liquid nitrogen pump, flowing nitrogen at an intermediate pressure which pressure is sufficiently low to allow vaporization by air condensation at the highest pressure of the process (about 23 bar for FIGS. 1, 3 and 5, and about 30 bar for FIG. 4). Additionally, in the case where all the oxygen to be produced can be vaporized by air condensation, the present invention may be utilized to also simultaneously produce gaseous nitrogen at high pressure, by pumping liquid nitrogen at this pressure, in a correspondingly similar manner as disclosed above. It is also possible to combine production of oxygen and nitrogen at high pressure with a flow rate adapted to the performances of the single or each of the cold blowers.

We claim:

1. A process for the production of a high pressure gaseous fluid comprising the steps of:

a) withdrawing a liquid stream from a cryogenic air separation process and pumping said liquid stream to at least said high pressure gaseous fluid pressure to form a high pressure liquid;

b) flowing said high pressure liquid stream to a heat exchanger for vaporization and reheating;

c) withdrawing an auxiliary gas from said heat exchanger at an intermediate location and at a first temperature which is close to the vaporization temperature of said high pressure fluid and flowing at least a portion of said withdrawn auxiliary gas at said first temperature to a compression means;

d) compressing said withdrawn auxiliary gas and reintroducing at least a portion of said compressed auxiliary gas into said heat exchanger, and;

e) withdrawing a second stream of auxiliary gas from said heat exchanger at a second temperature which is less than said first temperature.

2. A process according to claim 1, wherein the auxiliary gas comprises at least a portion of the incoming feed air for an air separation process.

3. A process according to claim 2, wherein said incoming feed air is first compressed at ambient temperature by a hot compressor.

4. A process according to claim 1, wherein the air separation is carried out in a double column system and said auxiliary gas comprises a gas withdrawn from a high pressure column, reheated to said first temperature and after said compression and said reintroduction is cooled and expanded into a low pressure column.

5. A process according to claim 1, wherein said auxiliary gas comprises a fluid derived from an air separation process.

6. A process according to claim 1, wherein at least a portion of said reintroduced compressed auxiliary gas is withdrawn from said heat exchanger and expanded in a turbine.

7. A process according to claim 6, wherein said turbine is mechanically coupled to an energy absorbing device to limit the enthalpy decrease of said auxiliary gas in said turbine.

8. A process according to claim 1, wherein said compression means is driven at least in part by a turbine to form said compressed auxiliary gas, and further wherein said turbine is driven at least in part by work derived from the expansion of at least a portion of said compressed auxiliary gas.

9. A process according to claim 1, wherein said high pressure fluid is at or above supercritical pressure and has a pseudo-vaporization temperature at said supercritical pressure and wherein said vaporization temperature is the pseudo-vaporization temperature.

10. A process for the production of a high pressure gaseous fluid comprising the steps of:

a) withdrawing a liquid stream from a cryogenic air separation process and pumping said liquid stream to at least said high pressure gaseous fluid pressure to form a high pressure liquid;

b) flowing said high pressure liquid stream to a heat exchanger for vaporization and reheating;

c) withdrawing an auxiliary gas from said heat exchanger at an intermediate location and at a first temperature which is close to the vaporization temperature of said high pressure fluid and flowing at least a portion of said withdrawn auxiliary gas at said first temperature to a compression means;

d) compressing said withdrawn auxiliary gas and reintroducing at least a portion of said compressed auxiliary gas into said heat exchanger, and;

e) withdrawing from said heat exchanger at a second location and flowing to an expansion turbine at least a portion of the compressed and reintroduced auxiliary gas.

11. A process according to claim 10, wherein the inlet temperature of said expansion turbine is less than said first temperature.

12. A process according to claim 10, wherein the auxiliary gas comprises at least a portion of the incoming feed air for an air separation process.

13. A process according to claim 12, wherein said incoming feed air is first compressed at ambient temperature by a hot compressor.

14. A Process according to claim 10, wherein said auxiliary gas comprises a fluid derived from an air separation process.

15. A process according to claim 10, wherein said compression means is driven at least in part by a turbine to form said compressed auxiliary gas, and further wherein said turbine is driven at least in part by work derived from the expansion of at least a portion of said compressed auxiliary gas.

16. A process according to claim 10, wherein said turbine is mechanically coupled to an energy absorbing device to limit the enthalpy decrease of said auxiliary gas in said turbine.

17. A process according to claim 10, wherein said high pressure fluid is at or above supercritical pressure and has a pseudo-vaporization temperature at said supercritical pressure and wherein said vaporization temperature is the pseudo-vaporization temperature.

18. A process for the production of a high pressure gaseous fluid comprising the steps of:

a) withdrawing a liquid stream from a cryogenic air separation process and pumping said liquid stream to at least said high pressure gaseous fluid pressure to form a high pressure liquid;

b) flowing said high pressure liquid stream to a heat exchanger for vaporization and reheating;

c) withdrawing an auxiliary gas from said heat exchanger at an intermediate location and at a first temperature which is close to the vaporization temperature of said high pressure fluid and flowing at least a portion of said withdrawn auxiliary gas at said first temperature to a compression means;

d) compressing said withdrawn auxiliary gas and reintroducing at least a portion of said compressed auxiliary gas into said heat exchanger;

wherein said auxiliary gas is a gas undergoing heating in said heat exchanger.

19. A process according to claim 18 wherein said gas undergoing heating is cycle nitrogen.

20. A process according to claim 18, wherein at least a portion of said reintroduced compressed auxiliary gas is withdrawn from said heat exchanger and expanded in a turbine.

21. A process according to claim 20, wherein said turbine is mechanically coupled to an energy absorbing device to limit the enthalpy decrease of said auxiliary gas in said turbine.

22. A process according to claim 18, wherein said compression means is driven at least in part by a turbine to form said compressed auxiliary gas, and further wherein said turbine is driven at least in part by work derived from the expansion of at least a portion of said compressed auxiliary gas.

23. A process according to claim 18, wherein said high pressure fluid is at or above supercritical pressure and has a pseudo-vaporization temperature at said supercritical pressure and wherein said vaporization temperature is the pseudo-vaporization temperature.

24. A process for the production of a high pressure gaseous fluid comprising the steps of:

a) withdrawing a liquid stream from a cryogenic air separation process and pumping said liquid stream to at least said high pressure gaseous fluid pressure to form a high pressure liquid;

b) flowing said high pressure liquid stream to a heat exchanger for vaporization and reheating;

c) withdrawing an auxiliary gas from said heat exchanger at an intermediate location and at a first temperature which is close to the vaporization temperature of said high pressure fluid and flowing at least a portion of said withdrawn auxiliary gas at said first temperature to a compression means;

d) compressing said withdrawn auxiliary gas and reintroducing at least a portion of said compressed auxiliary gas into said heat exchanger;

wherein said auxiliary gas is a nitrogen-enriched stream derived from an air separation.

25. A process according to claim 24, wherein at least a portion of said reintroduced compressed auxiliary gas is withdrawn from said heat exchanger and expanded in a turbine.

26. A process according to claim 24, wherein said compression means is driven at least in part by a turbine to form said compressed auxiliary gas, and further wherein said turbine is driven at least in part by work derived from the expansion of at least a portion of said compressed auxiliary gas.

27. A process according to claim 24, wherein said high pressure fluid is at or above supercritical pressure and has a pseudo-vaporization temperature at said supercritical pressure and wherein said vaporization temperature is the pseudo-vaporization temperature.

28. A process for the production of a high pressure gaseous fluid comprising the steps of:

a) withdrawing a liquid stream from a cryogenic air separation process and pumping said liquid stream to at least said high pressure gaseous fluid pressure to form a high pressure liquid;

b) flowing said high pressure liquid stream to a heat exchanger for vaporization and reheating;

c) withdrawing an auxiliary gas from said heat exchanger at an intermediate location and at a first temperature which is close to the vaporization temperature of said high pressure fluid and flowing at least a portion of said withdrawn auxiliary gas at said first temperature to a compression means;

d) compressing said withdrawn auxiliary gas and reintroducing at least a portion of said compressed auxiliary gas into said heat exchanger;

wherein all of the feed air to said air separation is fed to said heat exchanger at a single pressure.

29. A process according to claim 28, wherein the auxiliary gas comprises at least a portion of the incoming feed air for an air separation process.

30. A process according to claim 29, wherein said incoming feed air is first compressed at ambient temperature by a hot compressor.

31. A process according to claim 28, wherein the air separation is carried out in a double column system and said auxiliary gas comprises a gas withdrawn from a high pressure column, reheated to said first temperature and after said compression and said reintroduction is cooled and expanded into a low pressure column.

32. A process according to claim 28, wherein said auxiliary gas comprises a fluid derived from an air separation process.

33. A process according to claim 28, wherein at least a portion of said reintroduced compressed auxiliary gas is withdrawn from said heat exchanger and expanded in a turbine.

34. A process according to claim 33, wherein said turbine is mechanically coupled to an energy absorbing device to limit the enthalpy decrease of said auxiliary gas in said turbine.

35. A process according to claim 28, wherein said compression means is driven at least in part by a turbine to form said compressed auxiliary gas, and further wherein said turbine is driven at least in part by work derived from the expansion of at least a portion of said compressed auxiliary gas.

36. A process according to claim 28, wherein said high pressure fluid is at or above supercritical pressure and has a pseudo-vaporization temperature at said supercritical pressure and wherein said vaporization temperature is the pseudo-vaporization temperature.

37. A process for the production of a high pressure gaseous fluid comprising the steps of:

a) withdrawing a liquid stream from a cryogenic air separation process and pumping said liquid stream to at least said high pressure gaseous fluid pressure to form a high pressure liquid;

b) flowing said high pressure liquid stream to a heat exchanger for vaporization and reheating;

c) withdrawing an auxiliary gas from said heat exchanger at an intermediate location and at a first temperature which is close to the vaporization temperature of said high pressure fluid and flowing at least a portion of said withdrawn auxiliary gas at said first temperature to a compression means;

d) compressing said withdrawn auxiliary gas and reintroducing at least a portion of said compressed auxiliary gas into said heat exchanger;

wherein a portion of the feed air to said air separation is compressed to a first pressure and thereafter fed to the heat exchanger at said first pressure and the remainder of said feed air compressed to a second pressure and fed to said heat exchanger at said second pressure.

38. A process according to claim 37, wherein the auxiliary gas comprises at least a portion of the incoming feed air for an air separation process.

39. A process according to claim 37, wherein the air separation is carried out in a double column system and said auxiliary gas comprises a gas withdrawn from a high pressure column, reheated to said intermediate temperature and after said compression and said reintroduction is cooled and expanded into a low pressure column.

40. A process according to claim 37, wherein said auxiliary gas comprises a fluid derived from an air separation process.

41. A process according to claim 37, wherein at least a portion of said reintroduced compressed auxiliary gas is withdrawn from said heat exchanger and expanded in a turbine.

42. A process according to claim 41, wherein said turbine is mechanically coupled to an energy absorbing device to limit the enthalpy decrease of said auxiliary gas in said turbine.

43. A process according to claim 37, wherein said compression means is driven at least in part by a turbine to form said compressed auxiliary gas, and further wherein said turbine is driven at least in part by work derived from the expansion of at least a portion of said compressed auxiliary gas.

44. A process according to claim 37, wherein said high pressure fluid is at or above supercritical pressure and has a pseudo-vaporization temperature at said supercritical pressure and wherein said vaporization temperature is the pseudo-vaporization temperature.

45. An installation for the production of at least one high pressure gaseous fluid which comprises a fluid selected from the group consisting of oxygen and nitrogen by cryogenic air separation, said installation comprising a double column air separation system comprising a low pressure column and a high pressure column and a heat exchanger wherein incoming air is in heat-exchange relationship with fluids withdrawn from the double column system; said installation further comprising means to withdraw liquified fluid from the air separation unit and means to compress said withdrawn fluid with a pump, a cold blower, means for feeding said cold blower with an auxiliary gas which is withdrawn from the heat exchanger at an intermediate temperature, means for reintroducing said auxiliary gas into conduits of the heat exchanger; said installation further comprising conduit means for withdrawing and flowing to an expansion turbine at least a portion of said reintroduced auxiliary gas from said heat exchanger.

46. Installation according to claim 45, wherein said feeding means and cold blower are fluidly connected to passages of said heat exchanger for cooling the incoming air.

47. Installation according to claim 46, wherein said passages are fluidly connected with the output of a hot compressor driven by an expansion turbine.

48. Installation according to claim 45, comprising an air distillation double column, wherein the means for feeding air fluidly connected to high pressure air reheating passages of said heat exchanger, and wherein the means for reintroducing are connected to passages of said heat exchanger for cooling the compressed air.

49. Installation according to claim 45, wherein the installation comprises a nitrogen cycle comprising passages for reheating nitrogen in the heat exchanger, means to compress the heated nitrogen, and passages in said heat exchanger for cooling compressed nitrogen from the heat exchanger, wherein the heating means are connected to the cooling passages comprising the compressed nitrogen.

50. Installation according to claim 45, wherein the cold compressor is mechanically coupled to the expansion turbine.

51. Installation according to claim 50 wherein the input of the turbine is fluidly connected to passages of said heat exchanger wherein the compressed auxiliary gas is reintroduced.

52. Installation according to claim 51, wherein said installation further comprises pump means to increase the pressure of liquid oxygen or liquid nitrogen at a high pressure and means extending from the cold end to the hot end of the heat exchanger.

* * * * *